US011779082B2

(12) United States Patent
Chang et al.

(10) Patent No.: US 11,779,082 B2
(45) Date of Patent: Oct. 10, 2023

(54) LACE GUIDE FOR AN ARTICLE OF FOOTWEAR

(71) Applicant: NIKE, Inc., Beaverton, OR (US)

(72) Inventors: Leo S. Chang, Portland, OR (US); Kristina L. S. Kurcinka, Portland, OR (US); Jun Peng, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/689,176

(22) Filed: Mar. 8, 2022

(65) Prior Publication Data

US 2022/0192322 A1 Jun. 23, 2022

Related U.S. Application Data

(63) Continuation of application No. 16/578,667, filed on Sep. 23, 2019, now Pat. No. 11,337,491, which is a continuation of application No. 15/798,990, filed on Oct. 31, 2017, now Pat. No. 10,455,899.

(60) Provisional application No. 62/415,705, filed on Nov. 1, 2016.

(51) Int. Cl.

| | |
|---|---|
| ***A43C 7/08*** | (2006.01) |
| ***A43C 7/00*** | (2006.01) |
| ***A43C 1/06*** | (2006.01) |
| ***A43B 23/17*** | (2006.01) |
| ***A43C 3/00*** | (2006.01) |
| ***A43B 23/02*** | (2006.01) |
| ***A43B 23/08*** | (2006.01) |

(52) U.S. Cl.

CPC ..... *A43C 7/00* (2013.01); *A43B 23/0245* (2013.01); *A43B 23/088* (2013.01); *A43B 23/17* (2013.01); *A43C 1/06* (2013.01); *A43C 3/00* (2013.01); *A43C 7/08* (2013.01)

(58) Field of Classification Search

CPC .. A43C 1/06; A43C 7/00; A43C 7/005; A43C 7/08; A43C 3/00; A43B 23/088; A43B 23/17; A43B 23/0245; Y10T 24/3918; F16G 11/103

See application file for complete search history.

(56) References Cited

U.S. PATENT DOCUMENTS 1,470,261 A * 10/1923 Harrington ..... D06F 53/00 24/130
3,296,669 A * 1/1967 Elder, Jr. ..... F16G 11/103 D8/383
3,398,714 A * 8/1968 Rune ..... F16G 11/046 24/130

(Continued)

FOREIGN PATENT DOCUMENTS

CN 1196209 A 10/1998
CN 1939178 A 4/2007

(Continued)

*Primary Examiner* — Ted Kavanaugh
(74) *Attorney, Agent, or Firm* — Quinn IP Law

(57) ABSTRACT

A lace guide for an article of footwear comprises a base, a body protruding from the base, and an enlarged head at a distal end of the body. The body, the base, and the enlarged head define an external channel that extends at least partially around the body to receive and retain a lace. The base may be a heel counter, and the lace guide and the heel counter may be an integral, one-piece component. Alternatively, the base of the lace guide may be a wing extending along a side of the upper, or may be secured to a footwear upper.

8 Claims, 8 Drawing Sheets

(56) References Cited

U.S. PATENT DOCUMENTS

| | | | | | |
|---|---|---|---|---|---|
| 4,290,173 | A * | 9/1981 | Herlau | F16G 11/103 | 24/712.9 |
| 5,158,428 | A * | 10/1992 | Gessner | F16G 11/103 | 24/712.9 |
| 5,956,823 | A * | 9/1999 | Borel | A43C 7/00 | 24/712.9 |
| 7,596,838 | B1 * | 10/2009 | Bulmer | A43C 7/00 | 24/712.9 |
| 2002/0083621 | A1 * | 7/2002 | Durocher | A43C 7/00 | 36/50.1 |
| 2009/0249586 | A1 * | 10/2009 | Brown | F16G 11/106 | 24/115 M |
| 2010/0287791 | A1 * | 11/2010 | Liu | A43C 7/00 | 36/50.1 |
| 2012/0198721 | A1 * | 8/2012 | Cavaliere | A43B 7/14 | 36/42 |

FOREIGN PATENT DOCUMENTS

| | | | | |
|---|---|---|---|---|
| CN | 101658346 | A | 3/2010 | |
| EP | 0149362 | A2 | 7/1985 | |
| EP | 0274170 | A1 | 7/1988 | |
| EP | 2525679 | A1 | 11/2012 | |
| FR | 2851132 | A1 * | 8/2004 | A43C 3/02 |
| FR | 2985890 | A1 * | 7/2013 | A43C 7/08 |
| GB | 191225870 | A | 7/1913 | |
| JP | 2016500300 | A | 1/2016 | |
| KR | 200171552 | Y1 | 3/2000 | |
| KR | 20110003172 | U | 3/2011 | |
| KR | 20110007173 | U | 7/2011 | |
| TW | 201412259 | A | 4/2014 | |

* cited by examiner

LACE GUIDE FOR AN ARTICLE OF FOOTWEAR

CROSS-REFERENCE TO RELATED APPLICATIONS

This application is a continuation of U.S. application Ser. No. 16/578,667, filed Sep. 23, 2019, which is a continuation of U.S. application Ser. No. 15/798,990, filed Oct. 31, 2017, now U.S. Pat. No. 10,455,899, issued Oct. 29, 2019, which claims the benefit of priority to U.S. Provisional Application No. 62/415,705, filed Nov. 1, 2016, and all of which are incorporated by reference in their entirety.

TECHNICAL FIELD

The present teachings generally include a lace guide for an article of footwear.

BACKGROUND

Footwear may include an upper configured to go over and/or around a wearer's foot, and a sole structure coupled to the upper to space the wearer's foot above the ground. In addition, the footwear may include laces for adjusting the upper to the wearer's foot. The laces may be connected to the upper in order to allow the wearer to tighten the laces.

DESCRIPTION

Figure 1:
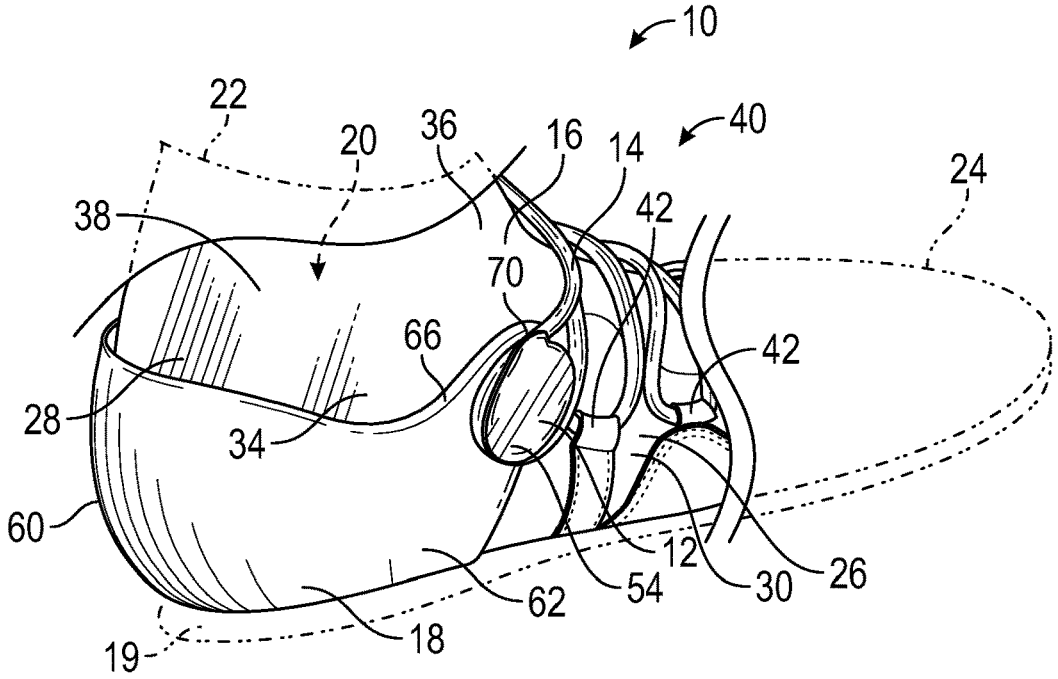
FIG. 1 is a schematic slightly perspective partial view of a lateral side of an article of footwear.

A lace guide for an article of footwear comprises a base, a body protruding from the base, and an enlarged head at a distal end of the body. The body, the base, and the enlarged head define an external channel that extends at least partially around the body to receive and retain a lace. The external channel may be annular.

In one or more embodiments, a first portion of an outer surface of the body in the channel includes a series of protrusions, and a second portion of the outer surface of the body in the channel is smoother than the first portion. The first portion may be generally above the second portion. For example, the lace may easily slide over the second portion when received in the channel, and the protrusions of the first portion help prevent the lace from sliding once positioned in the channel.

In one or more embodiments of the lace guide, the enlarged head has a lip extending from a periphery of the enlarged head toward the base, narrowing a width of the external channel at the lip. An opening of the external channel may have a first width at the lip, and a second width greater than the first width away from the lip. The lip may be biased toward the base to retain the lace in the external channel.

In one or more embodiments of the lace guide, the lip may be asymmetrical. The lip has a curved edge extending at an acute angle from a periphery of the enlarged head. The lip has a terminal edge extending from the periphery of the enlarged head to the curved edge. The lip extends furthest from the periphery of the enlarged head at the terminal edge.

In one or more embodiments of the lace guide, the base has a recess that extends within the body toward the enlarged head such that the body is partially hollow.

In one or more embodiments of the lace guide, the lace guide is integral with a heel counter. More specifically, the base of the lace guide may be a heel counter. The heel counter may include a heel cup, and a side wall extending from the heel cup on a lateral side or a medial side of the heel counter, and the base of the lace guide may be the side wall.

In one or more embodiments of the lace guide, the base has a recess extending toward the enlarged head, and the lace guide further comprises a disc with a stud. The stud fits in the recess to fasten the disc to the body. Alternatively, in one or more embodiments of the lace guide, prongs extend from the base opposite from the enlarged head.

A heel counter for an article of footwear comprises a base having a heel cup and a side wall extending forward from the heel cup. The heel counter includes a lace guide integral with the base, a body protruding outward from the side wall, and an enlarged head at a distal end of the body. The body, the base, and the enlarged head define an external annular channel that extends at least partially around the body between the enlarged head and the base to receive and retain a lace.

In one or more embodiments of the heel counter, the side wall of the heel counter includes a forward-inclining wing. The body protrudes outward from the forward-inclining wing. The enlarged head has a lip extending from a periphery of the enlarged head toward the base, narrowing a width of the external channel at the lip.

In one or more embodiments of the heel counter, the lip is asymmetrical, the lip has a trailing edge extending at an acute angle from the periphery of the enlarged head, and the lip has a leading edge extending from the periphery of the enlarged head to the trailing edge. The lip extends furthest from the periphery of the enlarged head at the leading edge.

In one or more embodiments of the heel counter, the side wall is at a lateral side of the base, the lace guide is a first lace guide, and the heel counter further includes a medial side wall extending forward from the heel cup at a medial side of the base, and a second lace guide integral with the medial side wall. The second lace guide includes a body protruding outward from the medial side wall, and an enlarged head at a distal end of the body. The body of the second lace guide, the medial side wall, and the enlarged head of the second lace guide define an external annular channel that extends at least partially around the body of the second lace guide between the enlarged head of the second lace guide and the medial side wall.

In one or more embodiments of the heel counter, a first portion of an outer surface of the body in the channel includes a series of protrusions, and a second portion of the outer surface of the body in the channel is smoother than the first portion.

An article of footwear comprises an upper forming a foot-receiving void, and a lace guide disposed at a side of the upper. The lace guide includes a base, a body protruding outward from the base, and an enlarged head at a distal end of the body. The body, the base, and the enlarged head define an external channel that extends at least partially around the body to receive and retain a lace.

In one or more embodiments of the article of footwear, a first portion of an outer surface of the body in the channel includes a series of protrusions, and a second portion of the outer surface of the body in the channel is smoother than the first portion. The first portion is above the second portion. A lace received in the channel will thus easily slide in the second portion, and wrap upward and around the first portion with the protrusions preventing back-sliding of the lace in the first portion.

In one or more embodiments of the article of footwear, the base is secured to a side of the upper. For example, the upper may comprise a textile, and the base may be secured to the textile.

In one or more embodiments of the article of footwear, the base has a recess extending toward the enlarged head. The lace guide includes a disc with a stud, and the stud fits in the recess to fasten the disc to the body. The upper has an aperture, and the stud passes through the aperture and fits in the recess to fasten the disc to the body. The upper is captured between the base and the disc when the stud fastens to the body in the recess.

In one or more embodiments of the article of footwear, the lace guide has prongs extending from the base opposite from the enlarged head. The upper has at least one aperture through which the prongs extend. The prongs bend outward such that the upper is captured between the base and the prongs. In one or more embodiments, the prongs are stitched to the upper.

In one or more embodiments of the article of footwear, the base is configured as a wing extending upward from a lower perimeter of the upper along a side of the upper.

In one or more embodiments, the article of footwear further comprises a heel counter secured to the upper. The heel counter has a heel cup, and a side wall extending forward from the heel cup. The base of the lace guide is the side wall of the heel counter.

In one or more embodiments, the side wall includes a forward-inclining wing, and the body protrudes outward from the forward-inclining wing.

In one or more embodiments, the enlarged head has a lip extending from a periphery of the enlarged head toward the base, narrowing a width of the external channel at the lip.

A method of manufacturing an article of footwear comprises molding a lace guide as a unitary, one-piece component having a base, a body protruding from the base, and an enlarged head at a distal end of the body. The body, the base, and the enlarged head define an external channel that extends at least partially around the body to receive and retain a lace. In one or more embodiments, molding the lace guide is injection molding or compression molding. Additionally, in one or more embodiments, molding the lace guide as a unitary, one-piece component includes molding a heel counter integrally with the lace guide.

In one or more embodiments, the method of manufacturing further comprises securing the base of the lace guide to a footwear upper by stitching, adhesion, radio frequency welding, thermal bonding, or fastening.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 schematically depicts an article of footwear 10 that includes a lace guide 12 configured as described herein to easily and quickly secure and retain a lace 14 for adjusting the fit of an upper 16 to the foot of a wearer. Various embodiments described herein include those with one or more lace guides 12, 12A integral with a heel counter 18 (see, e.g., FIGS. 1-14), an embodiment with a lace guide 12F in which the base 50F is a wing on a side of an upper (see FIG. 20), and an embodiment with one or more lace guides 12B, 12C, 12D, 12E, 12F secured to an upper 16 (see, e.g., FIGS. 15-19).

The upper 16 defines a foot-receiving void 20 that opens at an ankle opening 22. Both the upper 16 and the heel counter 18 may be secured to a sole structure 19 (depicted in phantom in FIG. 1) that spaces the upper 16 and heel counter 18 away from the ground and defines a ground contact surface. For reference purposes, any of the articles of footwear 10, 110, 210, 310, 410 that the lace guides 12, 12A, 12B, 12C, 12D, 12E, 12F disclosed herein may be used on may be an athletic shoe, such as a running shoe but is not limited to such, or a dress shoe, a work shoe, a sandal, a slipper, a boot, or any other category of footwear.

The article of footwear 10 may be divided into three general regions: a forefoot region 24, a midfoot region 26, and a heel region 28. The footwear 10 also includes a lateral side 30 and a medial side opposite to the lateral side 30 (such as medial side 32 shown in the embodiments of FIGS. 13-14). The forefoot region 24 generally includes portions of the article of footwear 10 corresponding with the toes and the joints connecting the metatarsals with the phalanges. The midfoot region 26 generally includes portions of the article of footwear 10 corresponding with the arch area of the foot, and the heel region 28 corresponds with rear portions of the foot, including the calcaneus bone. The lateral side 30 and medial side 32 extend through each of forefoot region 24, the midfoot region 26, and the heel region 28 and correspond with opposite sides of the article of footwear 10. The forefoot region 24, the midfoot region 26, the heel region 28, the lateral side 30 and the medial side 32 are not intended to demarcate precise areas of footwear 10, but are instead intended to represent general areas of footwear 10 to aid in the following discussion. In addition to the article of footwear 10, the relative locations of the forefoot region 24, the midfoot region 26, the heel region 28, the lateral side 30 and the medial side 32 may also be applied to the upper 16, the heel counter 18, and other components and individual elements thereof.

The sole structure 19 may include a midsole and an outsole. The midsole and outsole may be integrated as a unitary unisole. The midsole is secured to a lower surface of upper 16 and/or a strobel, and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole may incorporate fluid-filled chambers, plates, moderators, or other elements that further attenuate forces, enhance stability, or influence the motions of the foot, or the midsole may be primarily formed from a fluid-filled chamber. An outsole may be secured to a lower surface of the midsole and may be formed from a wear-resistant rubber material that is textured to impart traction and/or includes traction elements such as cleats. A sockliner may be located within the upper 16 and positioned to extend under a lower surface of the foot. Although this configuration for a sole structure provides an example of a sole structure that may be used in connection with the article of footwear 10, a variety of other configurations for the sole structure may also be utilized. Accordingly, the structure and features of the sole structure 19 or any sole structure utilized with the article of footwear 10 may vary considerably.

The various portions of the upper 16 may be formed from one or more of a plurality of material elements (e.g., textiles, polymer sheets, foam layers, leather, synthetic leather) that are stitched or bonded together to form the void 20 within the article of footwear 10 for receiving and securing a foot relative to the sole structure 19. The void 20 is shaped to accommodate the foot and extends along the lateral side of the foot, along the medial side of the foot, over the foot, around the heel, and under the foot. Access to the void 20 is provided by an ankle opening 22 that is at least partly located in the heel region 28. The upper 16 includes what may generally be referred to as a cover layer 34 which may include a tongue 36 and a heel portion 38.

A lacing system 40 is configured to selectively adjust and tighten the fit of the upper 16 to a foot inserted into the void 20. The lacing system 40 includes at least one elongated tensioning element that may be referred to as a lace 14. In the present disclosure, the term "tensioning element" or "lace" means a flexible, elongated structure capable of withstanding a tensile load and includes, but is not limited to, a cable, a lace, a strand, a wire, a cord, a thread, or a string, among others.

The lace 14 may be located to (a) resist stretching of the upper 16 in specific directions or locations, (b) limit excess movement of the foot relative to the sole structure 19 and the upper 16, (c) ensure that the foot remains properly positioned relative to the sole structure 19 and the upper 16, and (d) reinforce locations where forces are concentrated. As non-limiting examples, suitable materials for the lace 14 include various filaments, fibers, yarns, threads, cables, or ropes that are formed from rayon, polyamide, polyester, polyacrylic, silk, cotton, carbon, glass, aramids (e.g., para-aramid fibers and meta-aramid fibers), ultra-high molecular weight polyethylene, liquid crystal polymer, copper, aluminum, or steel.

The lacing system 40 may have features that secure and direct the lace 14 relative to the upper 16. For example, the lacing system 40 in FIG. 1 shows multiple looped anchors 42 through which a lace 14 winds as it progresses fore and aft as well as transversely along the upper 16, over the dorsal surface of a foot received in the void 20.

Figure 5:
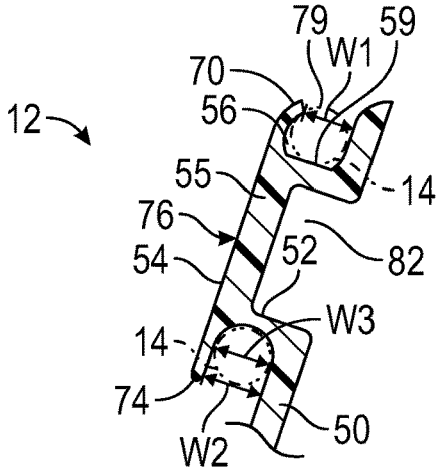
FIG. 5 is a schematic fragmentary cross-sectional view of a lace guide included in the heel counter of FIG. 3 taken at lines 5-5 in FIG. 3.
Figure 6:
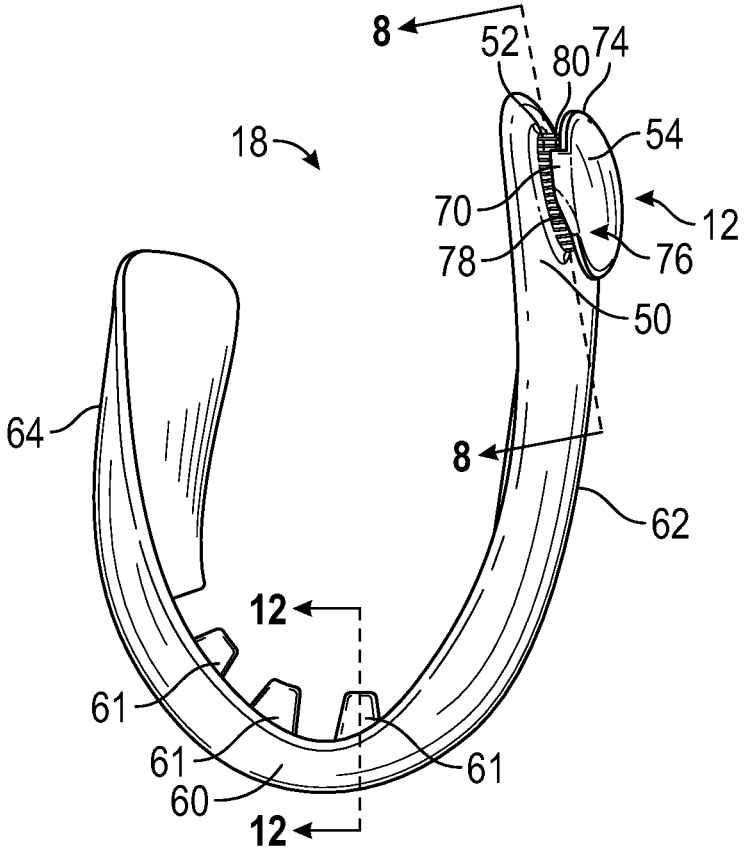
FIG. 6 is a schematic plan view of the heel counter of FIG. 3.
Figure 11:
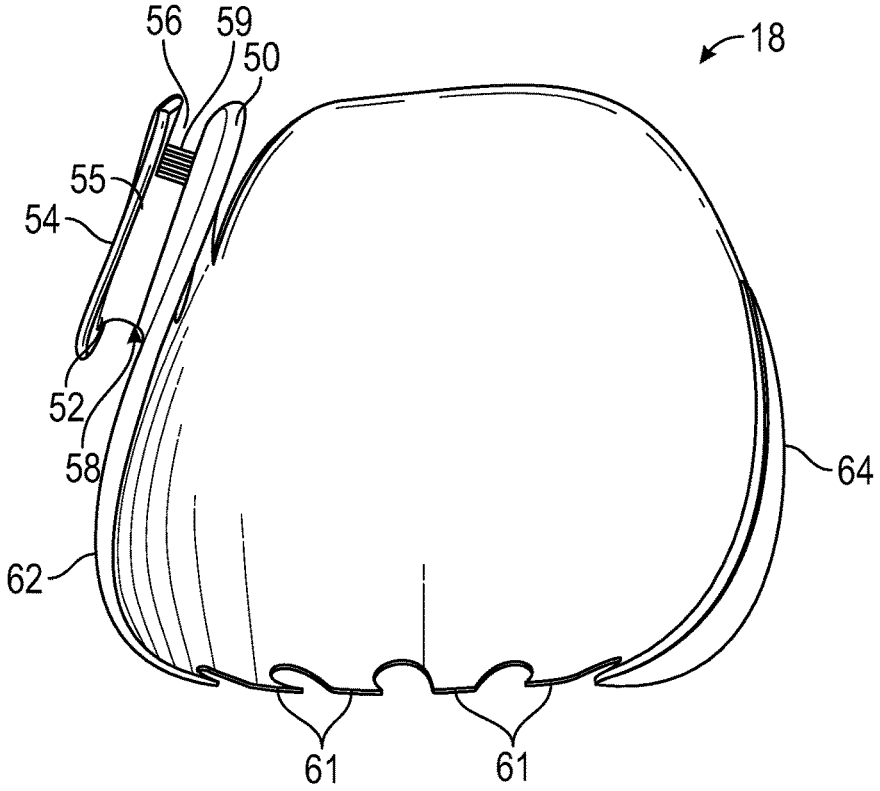
FIG. 11 is a schematic front view of the heel counter of FIG. 3.

The lacing system 40 includes at least one lace guide 12 as a feature that secures and directs the lace. As best shown in FIGS. 5 and 6, the lace guide 12 includes a base 50, a body 52 protruding from the base 50, and an enlarged head 54 at a distal end 55 of the body 52. As best shown in FIGS. 5 and 11, the body 52, the base 50, and the enlarged head 54 define an external channel 56 that extends at least partially around the body 52 to receive and retain the lace 14. The channel 56 is referred to as an "external" channel because it is exposed along its entire perimeter, as is evident from the combined views of FIGS. 2, 5, 6, and 9. This enables the lace 14 to easily fall into the channel 56 as it is looped around the body 52. Except under the lip 70 described herein, no threading of the lace 14 into the channel 56 is necessary, as would be required with an internal channel (i.e., a channel that is enclosed except at a lace inlet and a lace outlet).

Figure 7:
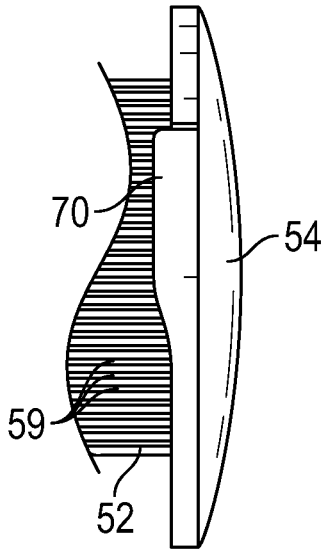
FIG. 7 is a schematic fragmentary top view of a lace guide of the heel counter of FIG. 6.
Figure 8:
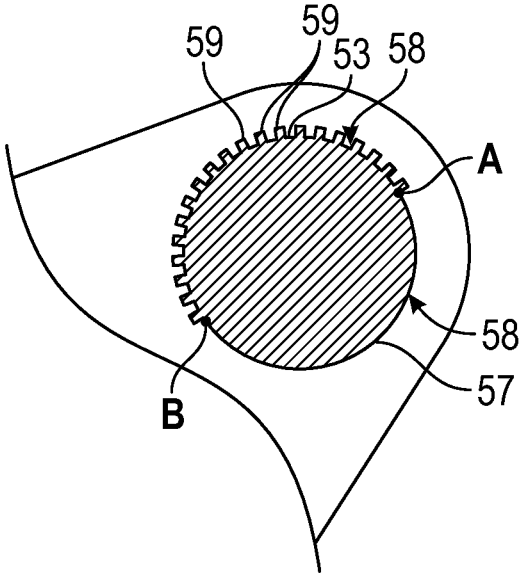
FIG. 8 is a schematic fragmentary cross-sectional view of the lace guide and the heel counter of FIG. 6 taken at lines 8-8 in FIG. 6.
Figure 9:
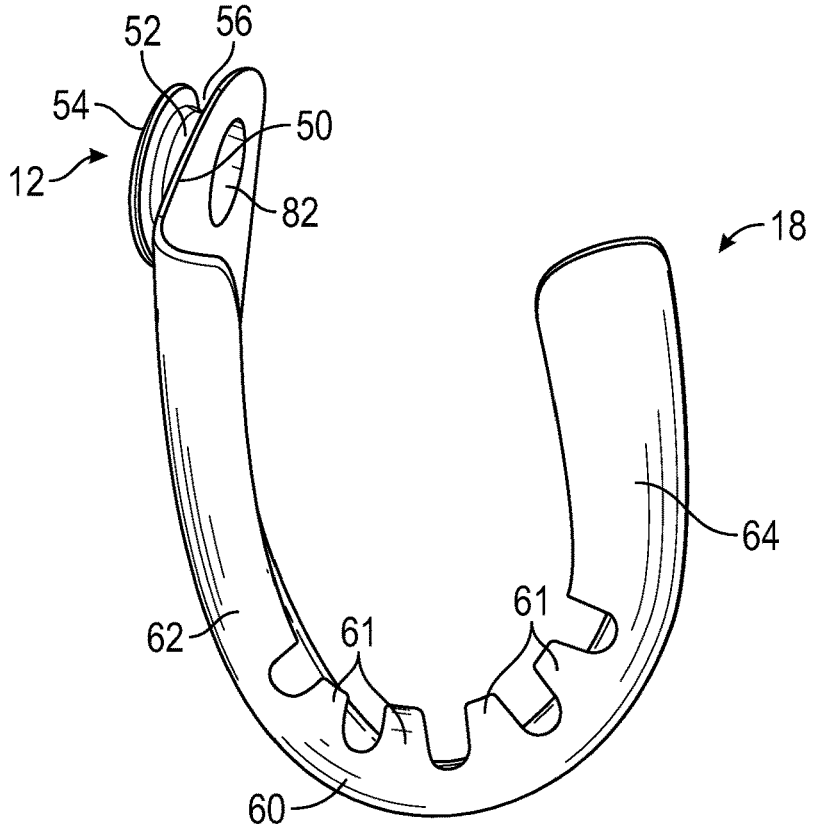
FIG. 9 is a schematic bottom view of the heel counter of FIG. 3.
Figure 10:
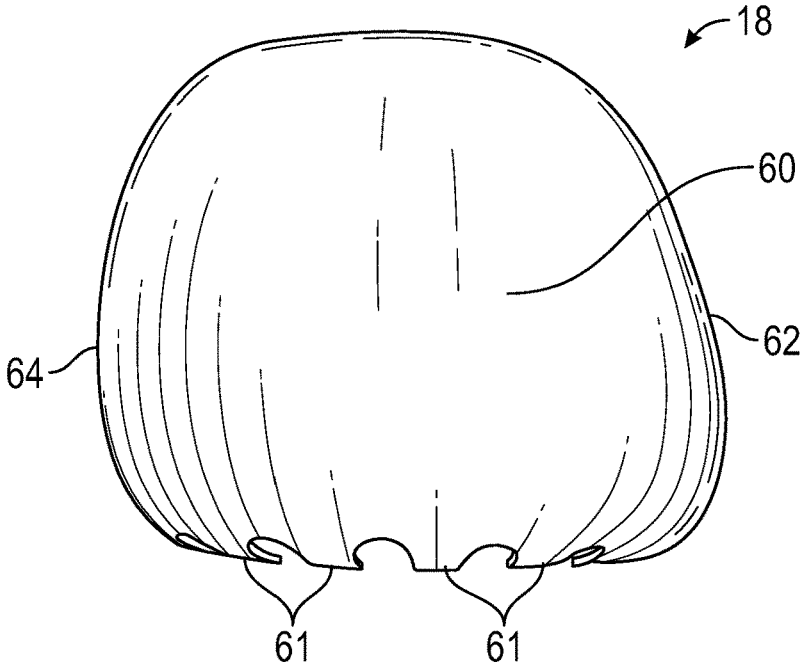
FIG. 10 is a schematic rear view of the heel counter of FIG. 3.

In the embodiment shown, the channel 56 is annular. The outer surface 58 of the body 52 in the channel 56 has a first portion 53 and a second portion 57. The first portion 53 extends along a portion of a perimeter of the body 52, counterclockwise from point A to point B in FIG. 8. The first portion 53 includes a series of protrusions 59. In the embodiment shown, the protrusions 59 are raised ridges that extend transversely across the channel 56, as best shown in FIG. 7. Other types of protrusions may be used instead of ridges. The protrusions 59 are flat in the transverse direction, as best indicated in FIG. 5. The second portion 57 extends from point A to point B clockwise and is generally below the first portion 53. The second portion 57 is relatively smooth in comparison to the first portion 53, as it has none of the protrusions 59. The second portion 57 is generally concave, as indicated in FIG. 5. The smooth second portion 57 is ideal for slidingly receiving and retaining the lace 14, which wraps clockwise as shown in FIG. 1, generally from point A toward point B along surface 58 in the second portion 57, then from point B toward point A along the first portion 53. The raised protrusions 59 create some friction that helps prevent the lace 14 from sliding back counterclockwise along the first portion 53. In other embodiments, the channel 56 could be only a portion of an annulus, and could have a portion that is squared off or any shape.

Figure 12:
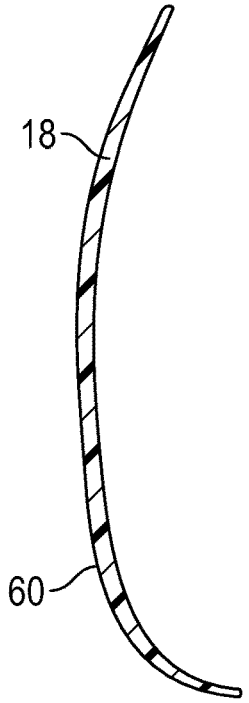
FIG. 12 is a schematic cross-sectional view of the heel counter of FIG. 3 taken at lines 12-12 in FIG. 6.
Figure 13:
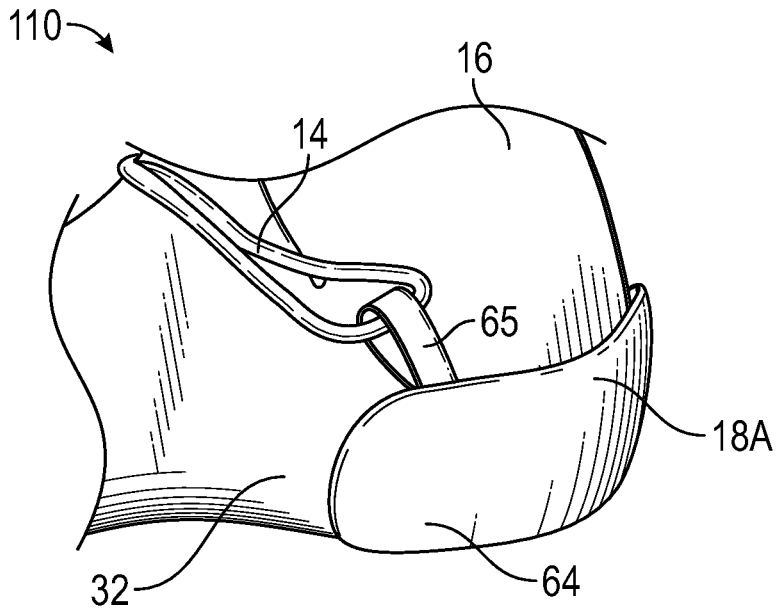
FIG. 13 is a schematic partial side view of a medial side of an alternative embodiment of an article of footwear with an alternative heel counter in accordance with an alternative aspect of the present teachings.

In the embodiments of FIGS. 1-12, the base 50 is a part of and is integrally formed with the heel counter 18, 18A, or 18B. More specifically, in FIG. 1, the base 50 is the lateral side wall 62 of the heel counter 18. The body 52 of the lace guide 12 protrudes outward from the lateral side wall 62. The heel counter 18 includes the lace guide 12, a heel cup 60, a lateral side wall 62, and a medial side wall 64. The heel cup 60 is generally rounded as best illustrated in FIGS. 6 and 9-12, and extends around the rear of the upper 16 and a foot received therein. The lateral side wall 62 and the medial side wall 64 both extend forward from the heel cup 60 and are positioned at the lateral side 30 and the medial side 32 of the upper 16, respectively. The heel counter 18 may be a relatively hard and having less ability to stretch and flex than the upper 16. For example, the heel counter may be a thermoplastic polyurethane, while the upper 16 may be a textile such as a stretchable nylon material. As illustrated in FIG. 12, the heel counter 18 is relatively thin. The heel counter 18 includes inward flanges 61 along the heel cup 60 that provide some flexibility in fit of the heel counter 18 to the lower portion of the upper 16 and/or to the sole structure 19.

The lace guide 12 is integrally formed with and is a part of the one-piece heel counter 18. The heel counter 18, including the heel cup 60, the side walls 62, 64, and the entire lace guide 12 is a one-piece, unitary component. By integrating the lace guide 12 with the lateral side wall 62 of the heel counter 18, the relative stiffness and inelasticity of the heel counter 18 is used advantageously to anchor the lace guide 12 and thereby the lace 14 to tighten the upper 16 relative to the heel counter 18. As best shown in FIGS. 1 and 6, the lateral side wall 62 includes a forward-inclining wing 66, and the body 52 protrudes outward from the forward-inclining wing 66. The forward-inclining wing 66 positions the lace guide 12 at a forward-most and highest extent of the heel counter 18, providing a different angle for tensioning the lace 14 disposed in the external channel 56, and allowing the wing 66 to wrap slightly around the upper 16, providing greater support.

In the embodiments of FIGS. 1-12, only one lace guide, referred to as a first lace guide 12, is integral with the heel counter 18, and is located on the lateral side wall 62 of the heel counter 18. The medial side wall 64 of the heel counter 18 has no lace guide or other lace retaining feature. In still another possible embodiment of an article of footwear 110, shown in FIG. 13, a heel counter 18A includes the lace guide 12 of FIG. 1, and further includes a looped fastener 65 can be secured to the medial side wall 64. The looped fastener 65 retains the lace 14 after it is wound around the body 52 of the lace guide 12 on the lateral side wall 62. Although the lace guide 12 is shown integrated with the lateral side wall 62 (i.e., with the base 50 as the lateral side wall 62 and the body 52 protruding from the lateral side wall 62), the lace guide 12 could instead be integrated with the medial side wall 64 (i.e., with the base 50 as the medial side wall 64 and the body 52 protruding from the medial side wall 64). In such an embodiment, the lateral side wall 62 could also have a lace guide 12, could have a looped fastener 65, or could have no lace retaining feature.

Referring to FIGS. 1, 3, 5, and 6, the enlarged head 54 has a lip 70 that helps to prevent the lace 14 from exiting the external channel 56 at the lip 70. By extending partially over the lace 14, the lip 70 effectively directs the lace 14 to exit the channel 56 just after a terminal edge 80 of the lip 70. More specifically, with reference to FIGS. 5 and 6, the lip 70 extends from a periphery 74 of the enlarged head 54, and slants away from an outer face 76 of the head 54 toward the base 50. The lip 70 extends only partway around the periphery 74 of the head 54, narrowing a width of the external channel 56 at the lip 70. An opening 79 of the external channel 56 has a first width W1 at the lip 70 and a second width W2 greater than the first width W1 away from the lip 70 (i.e., at the portion of the periphery 74 from which the lip 70 does not extend. The lip 70 thus partially overhangs the channel 56, partially covering the lace 14 in the channel 56. The second width W2 is greater than or equal to the width W3 of the lace 14 received in the channel 56. This allows easy entry of the lace 14, and quick, one-handed wrapping of the lace 14 around the body 52. The second width W2 at the lip 70 may be less than the width W3 of the lace. The lace 14 may be slightly compressible such that its width is greater than the width W1 and W2, and it may initially slip into the narrower width W2 at the lip 70. Additionally, or in the alternative, the lace 14 can be threaded through the portion of the channel 56 at the lip 70. The lip 70 is biased toward the base 50 to help retain the lace 14 in the external channel 56.

Figure 2:
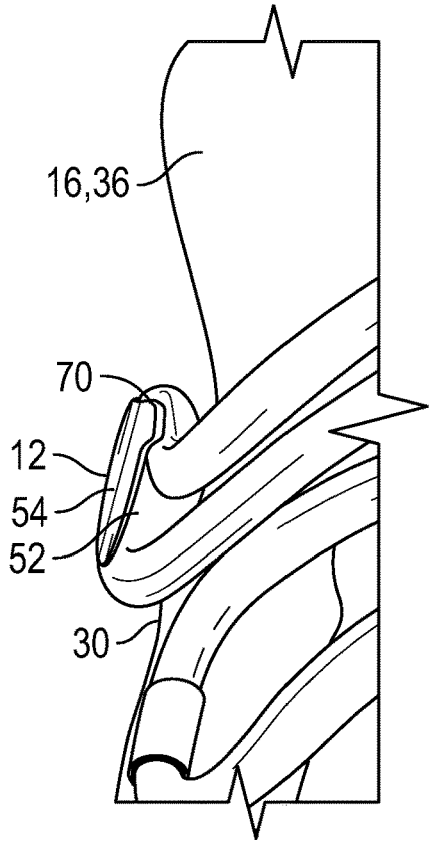
FIG. 2 is a schematic partial front view of the article of footwear of FIG. 1.
Figure 3:
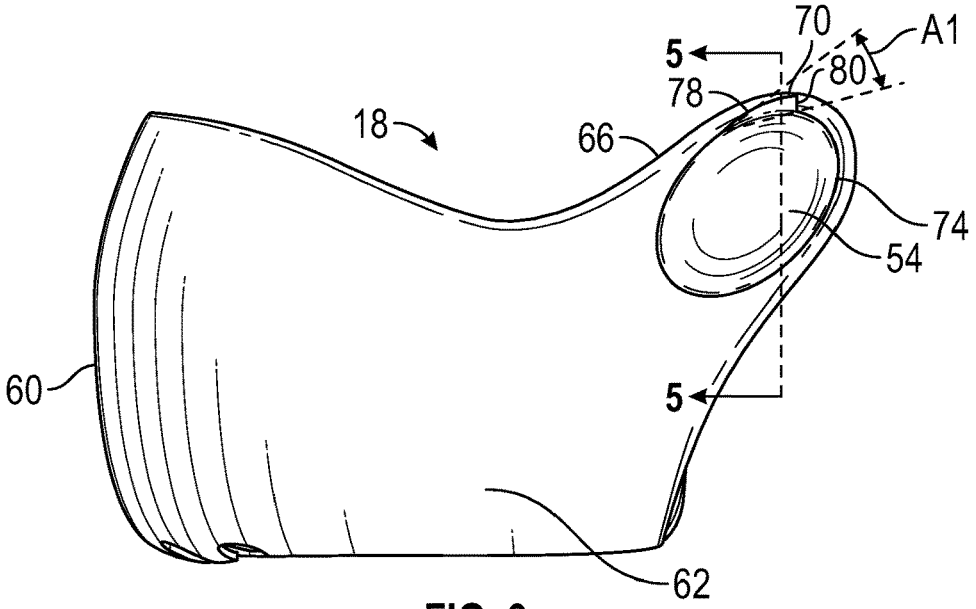
FIG. 3 is a schematic side view of a lateral side of a heel counter of the article of footwear of FIG. 1.

With reference to FIG. 3, the lip 70 has a curved edge 78, also referred to as a trailing edge 78, which extends at an acute angle A1 from the periphery 74 of the enlarged head 54. The lip 70 also has a terminal edge 80, also referred to as a leading edge 80, extending from the periphery 74 of the enlarged head to the trailing edge 78. The trailing edge 78 is referred to as trailing as it is rearward of the terminal edge 80 on the heel counter 18. The leading edge 80 is referred to as a leading edge as it is forward of the trailing edge 78 on the heel counter 18. The lip 70 extends furthest from the periphery 74 of the enlarged head 54 at the leading edge 80. With this configuration, the lip 70 is asymmetrical. As best shown in FIGS. 1 and 2, the trailing edge 78 gradually curves outward over the channel 56, holding the lace 14 in the channel 56 until the lace 14 passes under the terminal edge 80. After the lace 14 passes under the terminal edge 80, applied tensile forces (via other locations at which the lace is fastened or secured) may direct it out of the channel 56, and over the top of the upper 16, such as toward another fastening feature, as shown in FIG. 1. The placement of the lip 70 thus partially controls where the lace 14 exits the channel 56.

Figure 4:
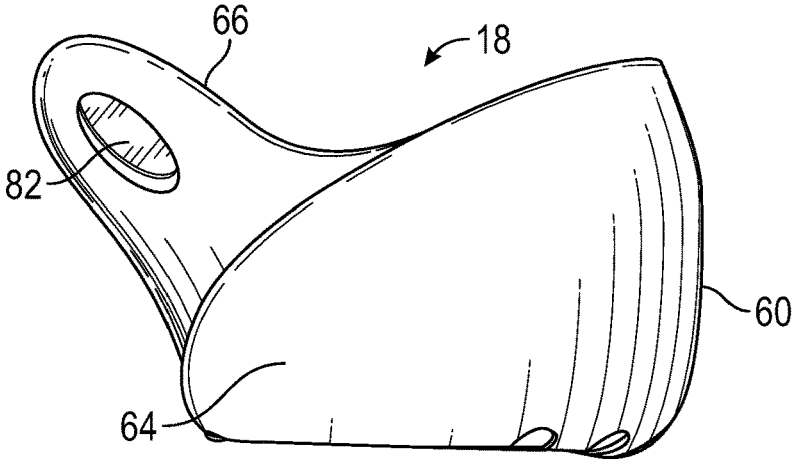
FIG. 4 is a schematic side view of a medial side of the heel counter of FIG. 3.

Referring to FIGS. 4 and 5, the base has a recess 82 that extends within the body 52 toward the enlarged head 54 such that the body 52 is partially hollow. The recess 82 reduces the added weight of the integral lace guide 12, and may result from a mold used to manufacture the lace guide 12. The integral heel counter 18 and lace guide 12 may be manufactured by molding as a one-piece component. For example, the molding may be injection molding or compression molding. In other embodiments, there may be no recess in the base 50.

Figure 14:
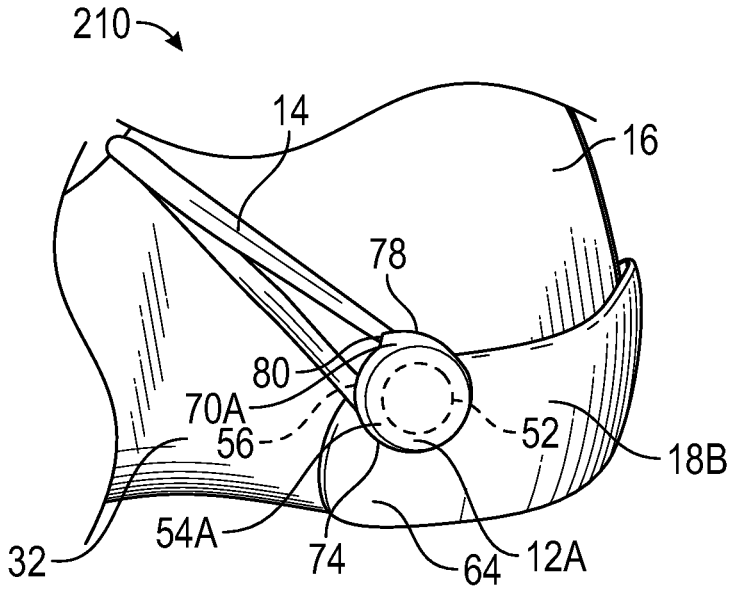
FIG. 14 is a schematic partial side view of a medial side of an alternative embodiment of an article of footwear with an alternative heel counter in accordance with an alternative aspect of the present teachings.

FIG. 14 shows an article of footwear 210 alike in all aspects to article of footwear 10, but with an alternative heel counter 18B with an additional lace guide 12A integral with the medial side wall 64 of the heel counter 18B. The heel counter 18B includes the lace guide 12 of FIG. 1 on the lateral side wall 62, as well as the lace guide 12A on the medial side wall 64. Stated differently, the heel counter 18B includes an integral first lace guide 12 on the lateral side wall 62 and second lace guide 12A on the medial side wall 64, and is one piece. The base of the second lace guide 12A is the medial side wall 64. The second lace guide 12A includes a body 52 protruding outward from the medial side wall 64, and an enlarged head 54A at a distal end of the body 52. The body 52 is indicated with hidden lines in FIG. 12, and is identical to body 52 of FIG. 5. The body 52 of the second lace guide 12A, the medial side wall 64, and the enlarged head 54A of the second lace guide 12A define an external annular channel 56 identical to that of lace guide 12 that extends at least partially around the body 52 of the second lace guide 12A between the enlarged head 54A and the medial side wall 64. A lip 70A extends from an outer periphery 74 of the enlarged head 54A. The lip 70A is a mirror image of lip 70. In other words, because the second lace guide 12A is on the medial side wall 64, the leading edge 80 is positioned counterclockwise along the outer periphery 74 relative to the trailing edge 78, whereas on lip 70, the leading edge 80 is positioned clockwise relative to the trailing edge 78 when the lace guides 12, 12A are viewed as shown in FIGS. 1 and 14.

Figure 17:
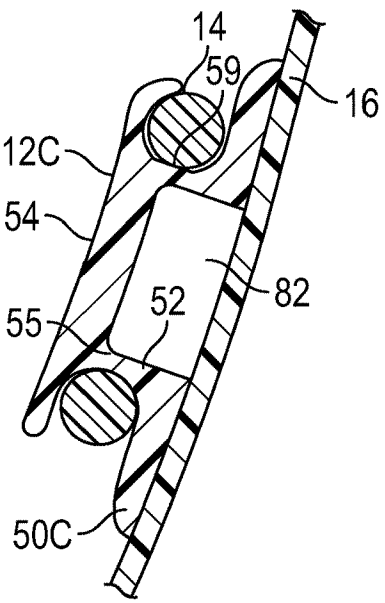
FIG. 17 is a schematic fragmentary cross-sectional view of a lace guide of the article of footwear of FIG. 16 taken at lines 17-17 in FIG. 16
Figure 16:
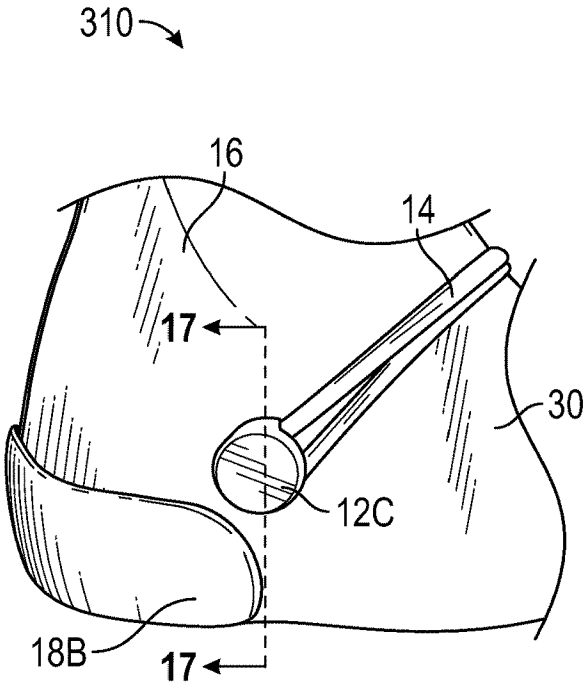
FIG. 16 is a schematic partial side view of a lateral side of the article of footwear of FIG. 15.
Figure 15:
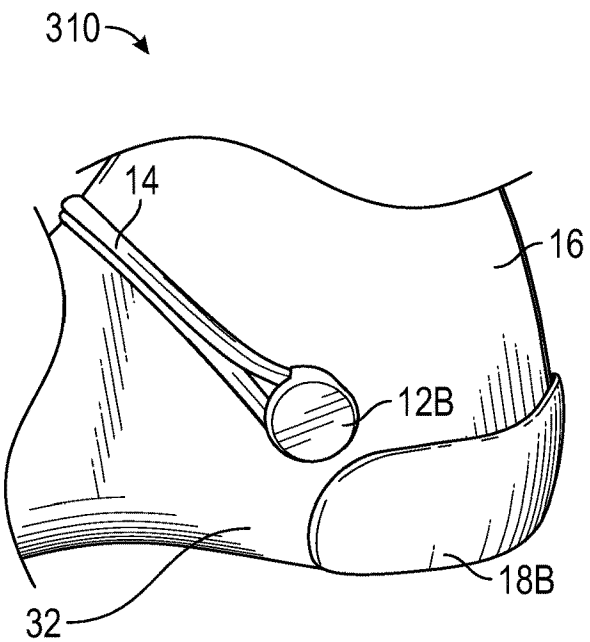
FIG. 15 is a schematic partial side view of a medial side of an alternative embodiment of an article of footwear in accordance with an alternative aspect of the present teachings.

FIGS. 15-17 show an alternative embodiment of an article of footwear 310 that includes the upper 16, a heel counter 18B, and lace guides 12B and 12C. The lace guide 12B is like the lace guide 12A of FIG. 14 in all aspects and the lace guide 12C is like the lace guide 12 in all aspects, except that, on both the lace guide 12B and 12C, the base is not a side wall of a heel counter 18B. Instead, the base 50C is a smaller expanse having an outer periphery greater than the width of the body so that the lace guide defines an external channel. FIG. 17 illustrates a base 50C as described. The base 50C is secured to a side of the upper 16 (lateral side 30 for the base of lace guide 12C, and medial side 32 for the base of lace guide 12B). The base 50C may be directly secured to the side of the upper 16 such as with stitching, adhesive, radio frequency welding or thermal bonding. For example, in one or more embodiments in which the upper 16 comprises a textile, the lace guide 12C may be stitched to the textile. The lace guides 12B and 12C are spaced from and not integral with the heel counter 18B.

Figure 19:
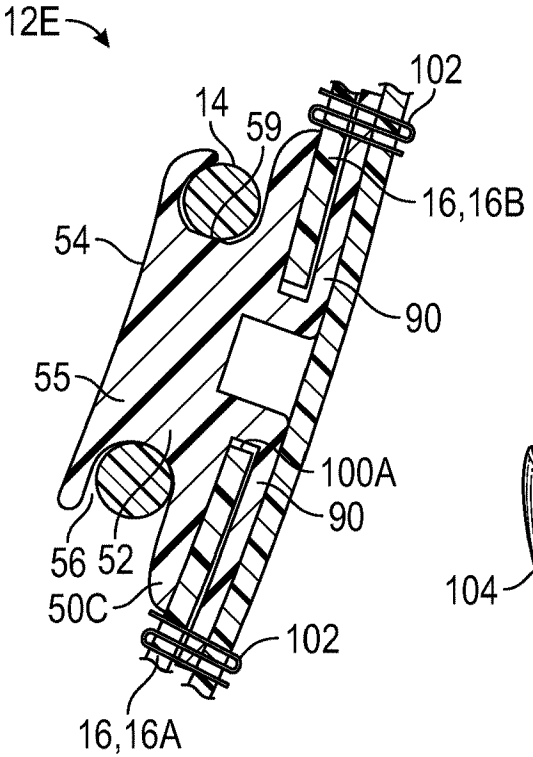
FIG. 19 is a schematic cross-sectional view of an alternative embodiment of a lace guide secured to an upper of an article of footwear.
Figure 18:
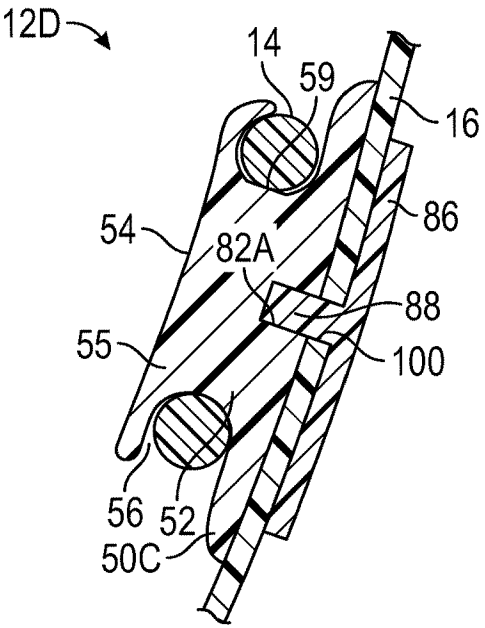
FIG. 18 is a schematic cross-sectional view of an alternative embodiment of a lace guide secured to an upper of an article of footwear.

FIGS. 18 and 19 show alternative ways that a lace guide can be attached directly to an upper 16 by fastening. In FIG. 18, a lace guide 12D has many of the same features as lace guide 12C of FIG. 17, and these are indicated with like reference numbers. The base 50C has a recess 82A extending toward the enlarged head 54. The recess 82A shown in generally centered in the base 50C, and is smaller than recess 82. The lace guide 12D further includes a disc 86 with a generally centrally located stud 88 that extends toward the enlarged head 54 and fits in the recess 82A to fasten the disc 86 to the body 52. For example, the stud 88 may be interference fit to the base 50C and body 52 in the recess 82A. The lace guide 12D can be fastened to the upper 16 by extending the stud 88 through an aperture 100 in the upper 16 when fitting the stud 88 to the body 52 in the recess 82A. The stud 88 thus passes through the aperture 100 and fits in the recess 82A to fasten the disc 86 to the body 52. The upper 16 is thus captured between the base 50C and the disc 86 when the stud 88 fastens to the body 52 in the recess 82A, thus securing the lace guide 12D to the upper 16.

In FIG. 19, a lace guide 12E has many of the same features as lace guide 12C of FIG. 17, and these are indicated with like reference numbers. The lace guide 12E has prongs 90 extending from the base 50C opposite from the enlarged head 54. The upper 16 has at least one aperture 100A through which the prongs 90 extend. In the embodiment shown, both prongs 90 extend through the same aperture 100A. In another embodiment, both prongs 90 extend through separate, smaller apertures. The prongs 90 bend outward such that the upper 16 is captured between the base 50C and the prongs 90, securing the lace guide 12E to the upper 16. The upper 16 may have multiple layers 16A, 16B, so that the prongs 90 are between the layers 16A, 16B. The bent prongs 90 captured between the layers 16A, 16B fasten the lace guide 12E to the upper 16, similarly to a rivet. Additionally, thread 102 may be stitched through the prongs 90 to secure the prongs 90 to the layers 16A, 16B.

Figure 20:
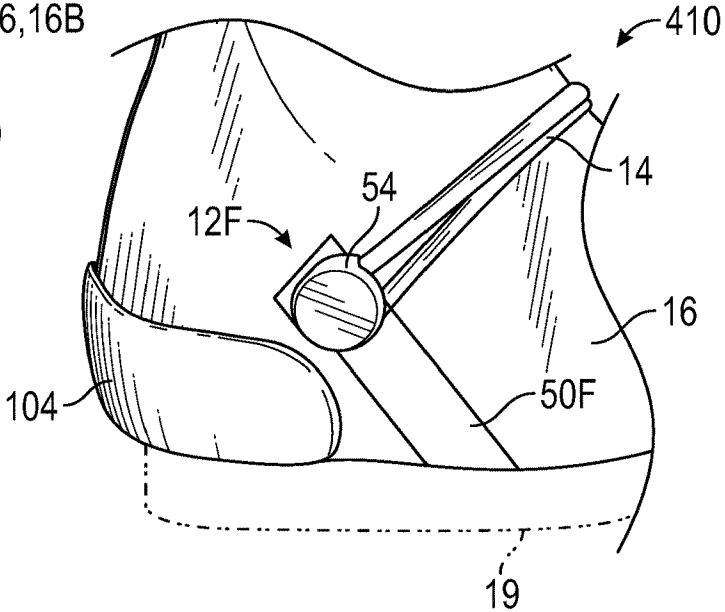
FIG. 20 is a schematic partial side view of a lateral side of an alternative embodiment of an article of footwear in accordance with an alternative aspect of the present teachings.

FIG. 20 shows an article of footwear 410 that includes another embodiment of a lace guide 12F. Lace guide 12F is like the lace guide 12 in all aspects, except that the base 50F of the lace guide 12F is a wing secured to the upper 16 and extending upward and rearward along the upper 16 from the sole structure 19. The base 50F is separate from the heel counter 104 of the article of footwear 410. The base 50F may be a plastic that is relatively hard in comparison to the upper, and is referred to as a wing for its rearward and upward orientation "A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above", "below", "upward", "downward", "top", "bottom", etc., may be used descriptively relative to the figures, without representing limitations on the scope of the invention, as defined by the claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A lace guide for an article of footwear comprising:

a base;

a body protruding from the base; and an enlarged head at a distal end of the body;

wherein:

the body, the base, and the enlarged head define an annular external channel that extends at least partially around the body to receive and retain a lace;

a first portion of an outer surface of the body in the annular external channel includes a series of protrusions extending radially-outward from the body into the annular external channel and transversely entirely across the annular external channel from the base to the enlarged head;

outer edges of the protrusions terminate at the base and the enlarged head and are straight and flat in a transverse direction across the annular external channel from the base to the enlarged head; and a second portion of the outer surface of the body in the annular external channel is smoother than the first portion.

2. The lace guide of claim 1, wherein the second portion is above the first portion.

3. The lace guide of claim 1, wherein the second portion has no protrusions.

4. The lace guide of claim 1, wherein:

the enlarged head has a lip extending from a periphery of the enlarged head toward the base, narrowing a width of the annular external channel at the lip;

the lip is asymmetrical; and the lip has a curved edge extending at an acute angle from the periphery of the enlarged head in a direction around the body and along the annular external channel.

5. The lace guide of claim 1, wherein:

the base is a heel counter;

the heel counter includes:

a heel cup, and a side wall extending from the heel cup on a lateral side or a medial side of the heel counter; and the body extends from the side wall.

6. The lace guide of claim 1, wherein a perimeter of the second portion of the outer surface of the body in the annular external channel is a semi-circle.

7. The lace guide of claim 1, wherein the outer edges of the protrusions are linear and of a constant thickness from the base to the enlarged head.

8. The lace guide of claim 1, wherein opposing sides of the protrusions extend orthogonally to the outer edges.

* * * * *